United States Patent [19]

Chen et al.

[11] 4,369,543

[45] Jan. 25, 1983

[54] REMOTE-CONTROL RADIO VACUUM CLEANER

[76] Inventors: Jen Chen; Hong Chen, both of 36, La. 290, Kuan-Fu South Rd., Taipei, Taiwan

[21] Appl. No.: 253,496

[22] Filed: Apr. 13, 1981

[30] Foreign Application Priority Data

Apr. 14, 1980 [TW] Taiwan ..... 6921719

[51] Int. Cl.[3] ..... A47L 9/00

[52] U.S. Cl. ..... 15/319; 15/339; 15/340; 180/98; 340/825.72

[58] Field of Search ..... 15/319, 339, 340; 325/37; 180/98

[56] References Cited

U.S. PATENT DOCUMENTS

| | | | |
|---|---|---|---|
| 3,626,545 | 12/1971 | Sparrow | 15/339 X |
| 3,789,939 | 2/1974 | Geislinger | 15/319 X |
| 3,837,028 | 9/1974 | Bridge | 15/320 X |
| 4,114,711 | 9/1978 | Wilkins | 15/319 X |
| 4,173,809 | 11/1979 | Ku | 15/319 |
| 4,306,329 | 12/1981 | Yokoi | 15/319 |

*Primary Examiner*—Chris K. Moore

*Attorney, Agent, or Firm*—Millen & White

[57] ABSTRACT

A remote-control radio vacuum cleaner comprises a remote control device having radio transmitting circuits matched with a control mechanism for generating various control signals, and a separate vacuum cleaner structure disposed with vacuum cleaning fittings for dust suction operations, a storage battery system for supplying the required power in the vacuum cleaning structure, a radio receiving circuit disposed with respect to the transmitting circuits, and d.c. motors arranged in conjunction with the radio receiving circuit for moving the vacuum cleaner in performing dust cleaning work under the control of the remote control device.

8 Claims, 9 Drawing Figures

REMOTE-CONTROL RADIO VACUUM CLEANER

BACKGROUND OF THE INVENTION

1. Field of the Invention

The present invention relates to a novel vacuum cleaner, particularly, to a radio vacuum cleaner with remote control device for dust cleaning operation without external power line connection.

2. Description of the Prior Art

Conventionally, all vacuum cleaners usually require external power supply and manual traction. Because power sockets installed in buildings are not usually available at all locations, it is necessary to provide the vacuum cleaner with a long power cord, and sometimes, an extension line is required for cleaning the spacious areas. In addition, because the cleaning operation has to be performed by manual traction from place to place, tangling of the power cord or pulling of the power plug out of the power socket often occurs. Therefore, the inconvenience of requiring an external power line leaves much room for improvement in the prior art vacuum cleaner.

SUMMARY OF THE INVENTION

This invention is a novel and improved vacuum cleaner with radio transmitting and receiving devices for automatic dust cleaning operations.

The primary object of this invention is to provide a radio vacuum cleaner with a remote control device for transmitting various control signals in guiding the vacuum cleaner to perform the desired cleaning operations without external power line connection.

Another object of this invention is to provide a radio vacuum cleaner with a d.c. motor system in conjunction with radio receiving circuits for performing dust cleaning operations under the command of the remote control device.

Still another object of this invention is to provide a radio vacuum cleaner with a re-chargeable battery device for self-powered cleaning operations.

Other objects and advantages of this invention will become apparent to those skilled in the art from the following detailed description of a preferred embodiment when read in connection with the accompanying drawings.

DETAILED DESCRIPTION OF THE PREFERRED EMBODIMENT

Figure 1:
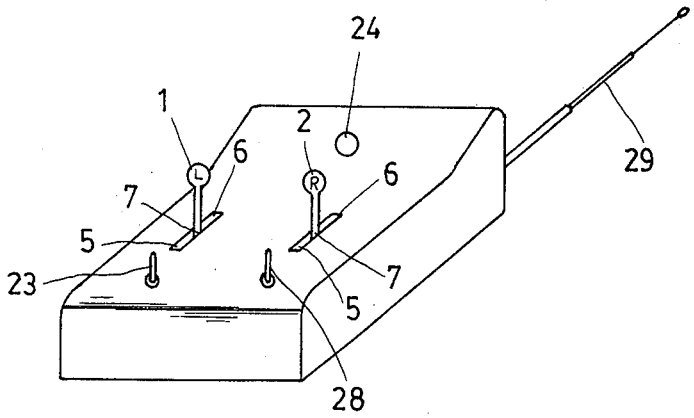
FIG. 1 is a schematic illustration of a remote control device according to a preferred embodiment of this invention.

Referring to FIG. 1, the outward structure of a remote control device according to the preferred embodiment of this invention has a power switch 23 for turning on or off a dry battery source (not shown) of the remote control device; a remote control switch 28 for generating control signals from the remote control device; a left operating lever 1 and a right operating lever 2, both of which are separately arranged and movable in a slot provided with forward position 5, backward position 6, and stop position 7 in the middle for performing remote control action; an indicating lamp 24 for showing the power state of the dry battery source in the remote control device; and an antenna 29 for transmitting various signals from the remote control device.

Figure 2:
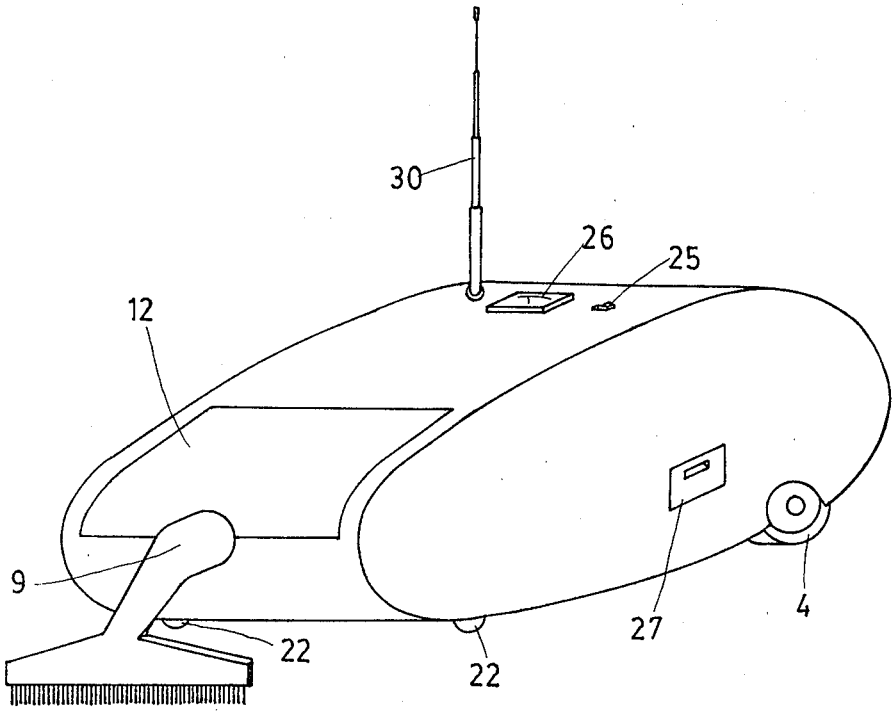
FIG. 2 is a schematic illustration of a radio vacuum cleaner according to a preferred embodiment of this invention.

Shown in FIG. 2, the outward structure of the radio vacuum cleaner embodying this invention includes a suction pipe 9 extending out of the vacuum cleaner with a suction brush formed in such a way that the suction brush is kept in touch with the floor surface for dust cleaning operations; an upper cover 12 easily opened and closed for removing the dust stored within the cleaner; a receiving antenna 30 extending out of the structure for receiving signals transmitted from the remote control device; a voltmeter 26 for indicating the power level of a d.c. power source within the vacuum cleaner; a power switch 25 adjacent to the voltameter 26 for turning on or off the vacuum cleaner; a side cover 27 movably hinged on the side of the structure for charging operations; a pair of rear wheels 3 and 4 (only one shown) fixed at both sides of the structure for moving the vacuum cleaner; and a pair of front wheels 22 made of a rubber caster type disposed at both sides of the structure for free movement in conjunction with the rear wheels 3 and 4 thereof.

Figure 3:
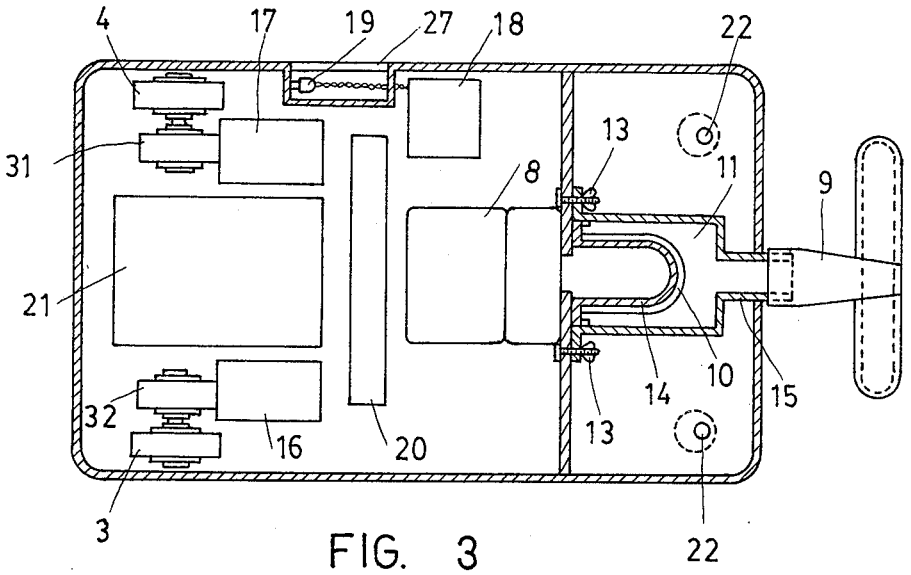
FIG. 3 is a top plan sectional view of the radio vacuum cleaner shown in FIG. 2.
Figure 4:
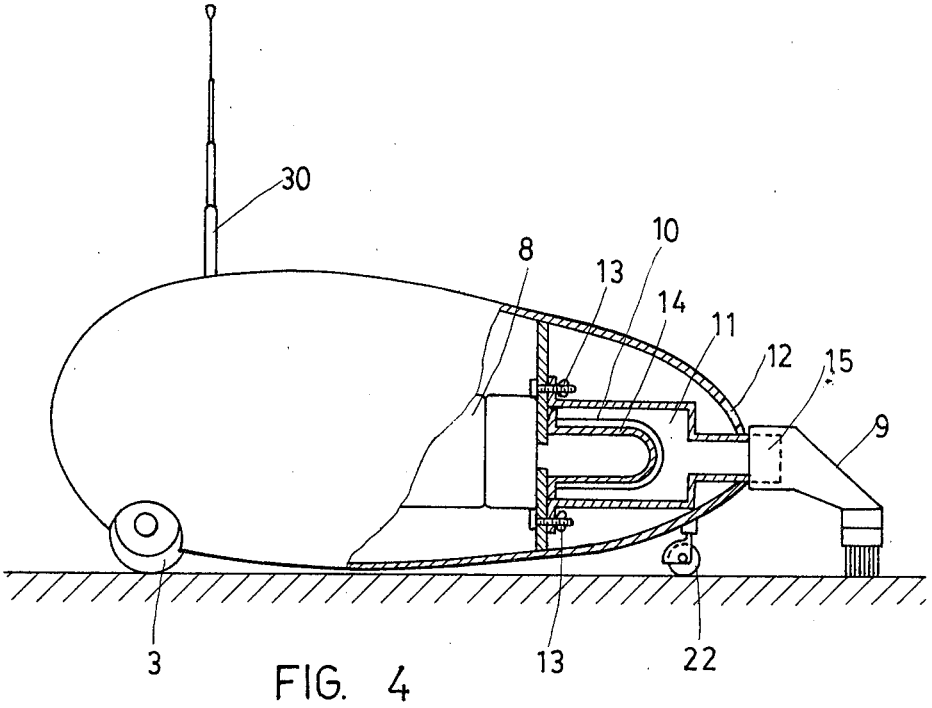
FIG. 4 is a partly sectional side view of the radio vacuum cleaner shown in FIG. 2.

Referring to FIGS. 3 and 4, the inward arrangement of a radio vacuum cleaner embodying this invention comprises a filter protruding tube 15 attachably connected with the suction pipe 9; a filter 11 communicating with the suction pipe 9; a filter bowl 14 located within the filter 11 and covered by a piece of filter cloth 10; a set of butterfly nuts 13 securing the filter 11 in position; a vacuum cleaning means 8 coupled with the filter 11; a rectifying and charging means 18 installed for battery charging operations; a radio receiving circuit 20 disposed therein for receiving signals transmitted from the remote control device and energizing the movement of the vacuum cleaner; a charging plug 19 stored behind the side cover 27; two d.c. motors 16 and 17 disposed on opposing sides with respect to the receiving circuit 20; a speed reducer 31 coupled between the d.c. motor 17 and the rear wheel 4 on the left side, and a speed reducer 32 coupled between the d.c. motor 16 and the rear wheel 3 on the right side for speed matching thereof; and a set of storage batteries 21 installed therein for supplying the d.c. power required for running the vacuum cleaner.

Figure 5:
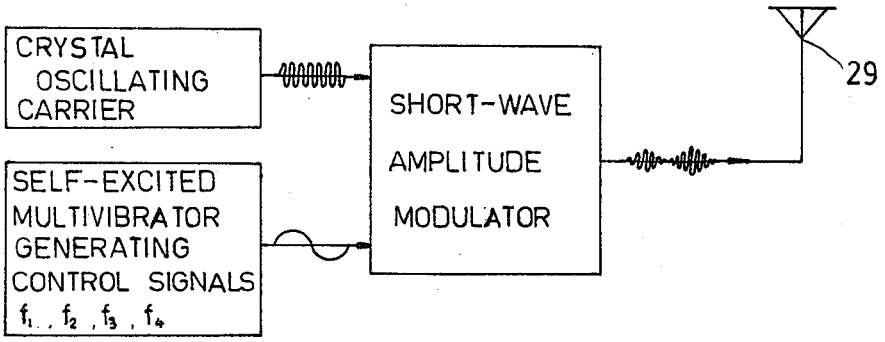
FIG. 5 is a block diagram of a transmitting circuit disposed in the remote control device according to the preferred embodiment of this invention.
Figure 6:
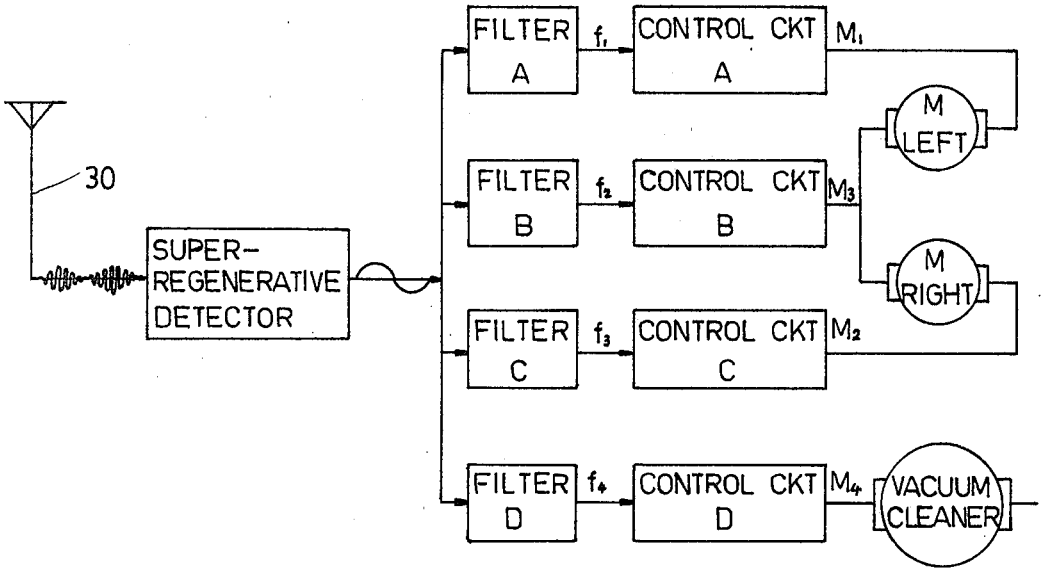
FIG. 6 is a block diagram of a receiving circuit disposed in the radio vacuum cleaner according to the preferred embodiment of this invention.
Figure 7:
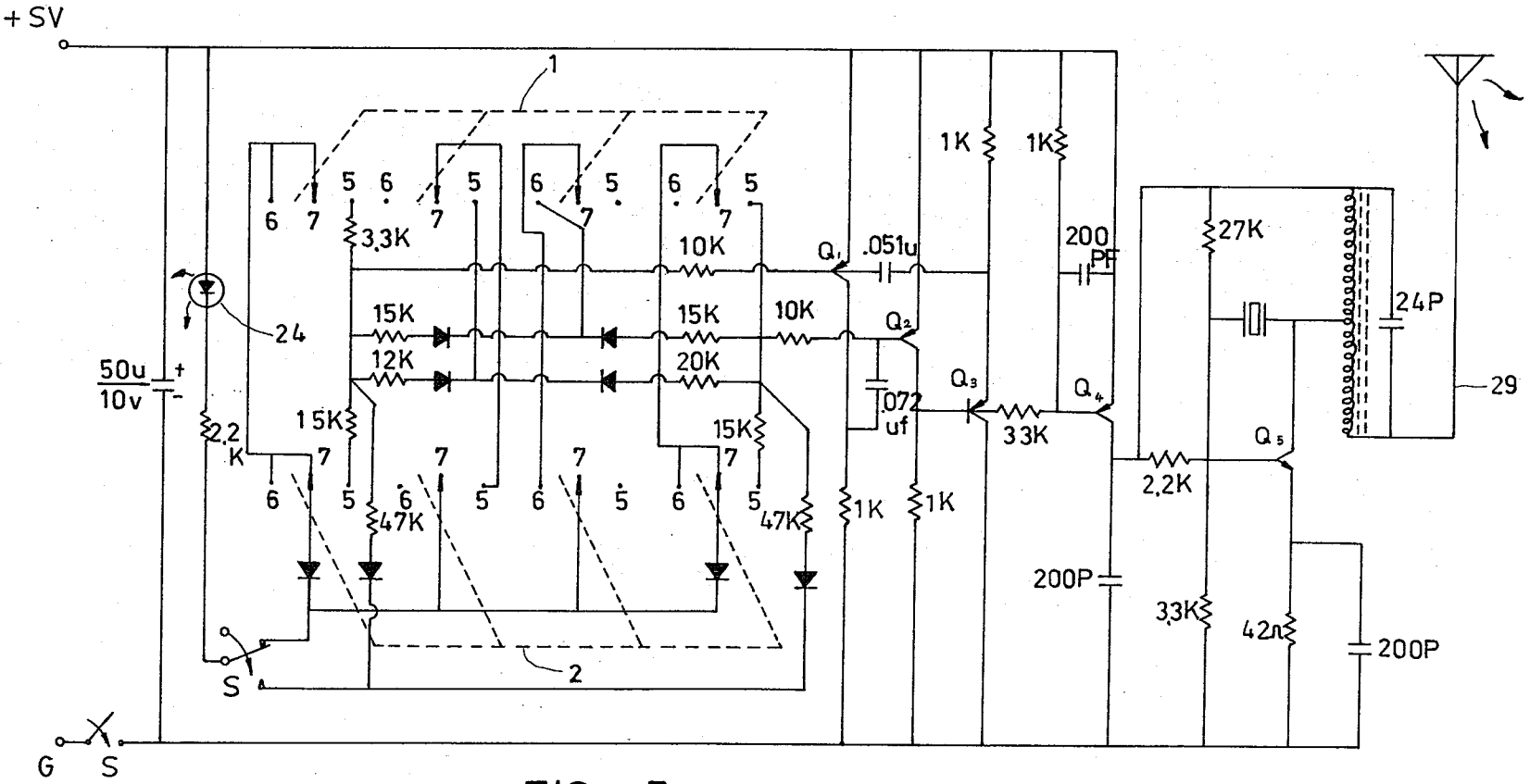
FIG. 7 is a circuit diagram of the transmitting circuit of the remote control device according to the preferred embodiment of this invention.
Figure 8:
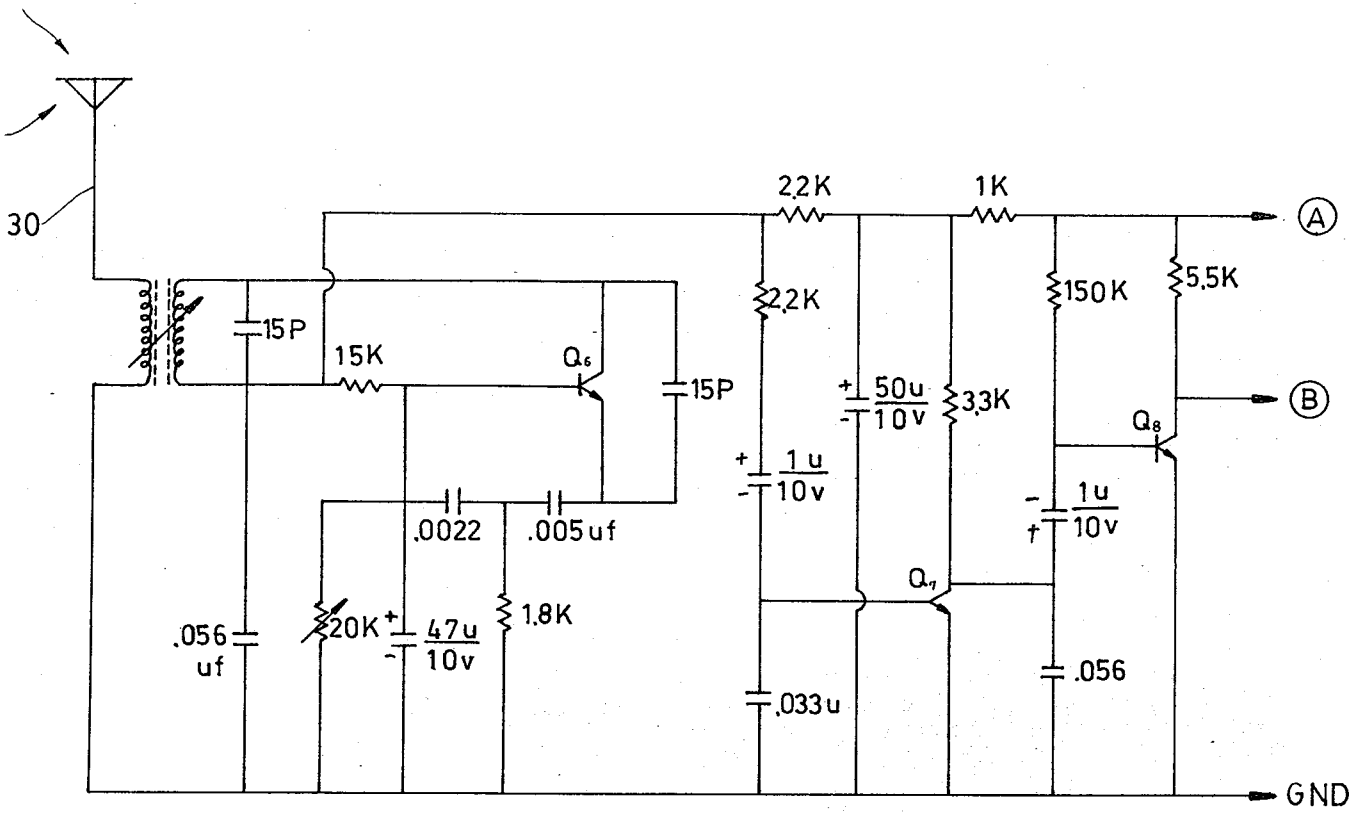
FIG. 8 is a circuit diagram of the receiving circuit of the radio vacuum cleaner according to the preferred embodiment of this invention.
Figure 9:
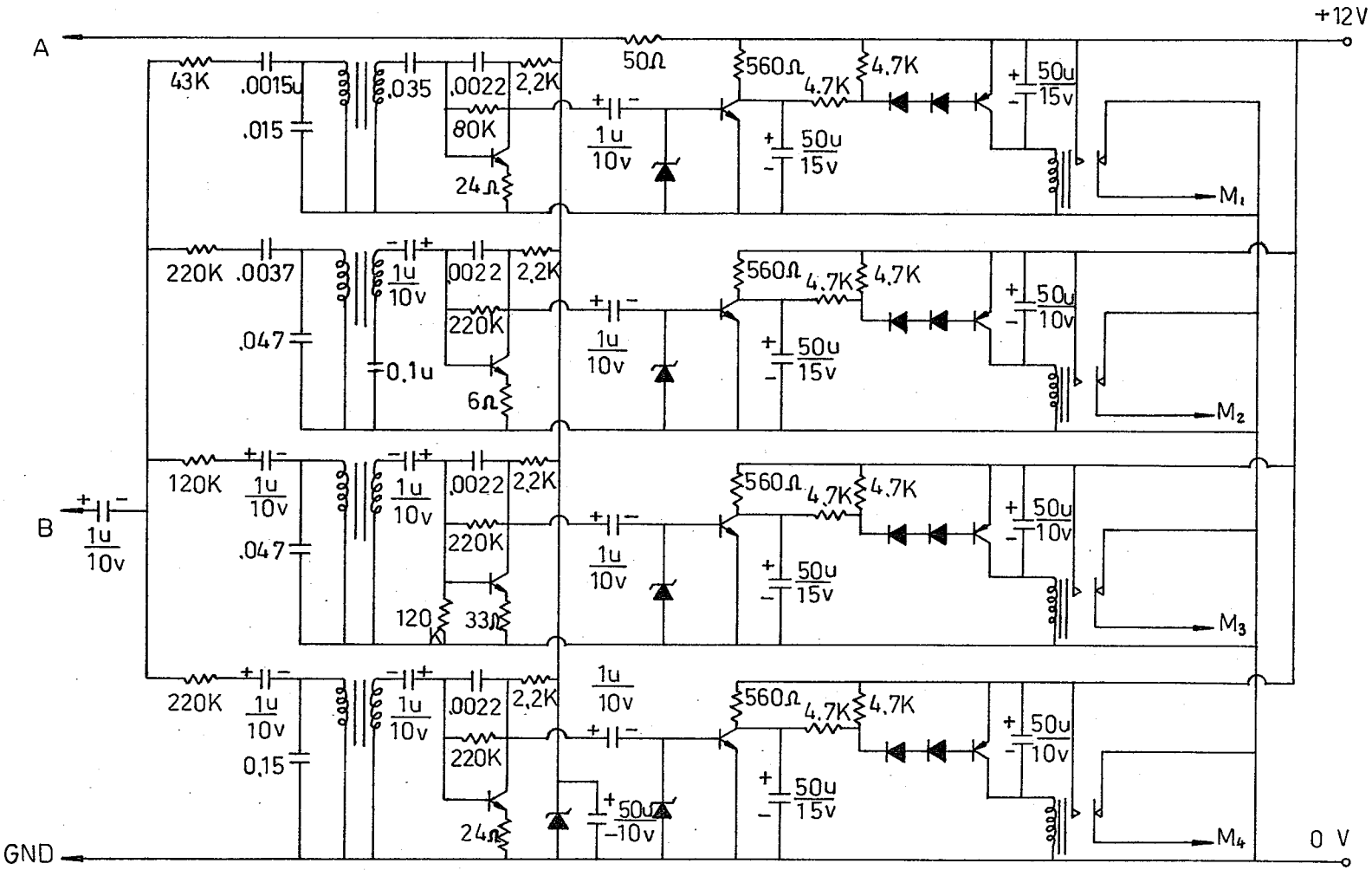
FIG. 9 is a circuit diagram of the receiving circuit of the radio vacuum cleaner as continued from FIG. 8 according to the preferred embodiment of this invention.

FIGS. 5 and 7 illustrate the transmitting circuit in the remote control device, while FIGS. 6, 8 and 9 are the receiving circuits disposed in the vacuum cleaner.

Referring to FIGS. 5 and 7, the transmitting circuit disposed in the remote control device is a self-excited multivibrator design for generating various control frequencies f1, f2, f3, and f4, which, after being matched with the carrier signal produced by a crystal oscillator and being modulated by a short-wave amplitude modulator, will be transmitted through the antenna 29.

In the receiving circuit (see FIGS. 6, 8, and 9), a super-regenerative detector is adopted for detecting the weak signals received from the transmitting circuit through the antenna 30. After amplification, the received control signals are fed out through various functional channels M1, M2, M3 and M4 (FIG. 9) for performing the automatic cleaning operations. The super-regenerative detector has a signal detecting capability so that the remote control device only requires a minute quantity of dry-battery source to transmit the signals, which can be picked up effectively by the detector within 50 meters.

In practical operations, first, turn on the power switch 23 on the remote control device (see FIG. 1), the indicating lamp 24 will be lit meaning that the power supply within the remote control device is sufficient; then, turn on the power switch 25 on the vacuum cleaner (see FIG. 2), the voltmeter 26 adjacent to the power switch 25 will indicate the power level of the storage battery 21 (see FIG. 3). When both power on the remote control device and the vacuum cleaner are normal, turn on the remote control switch 28 (see FIG. 1), the vacuum cleaning means 8 (see FIG. 3) will start running, ready for cleaning operations.

The movement of the rear wheels 3 and 4 are under the control of the operating levers 1 and 2. As shown in FIG. 7, the self-excited multivibrating circuit disposed in the remote control device in conjunction with a three-throw-and-four-throw knife switch being controlled by the operating lever 1 and 2 can transmit various control signals therefrom. When the right operating lever 2 is set at the forward position 5, the relay channel M1 (see FIGS. 8 & 9) will be energized and effect a positive output for starting the d.c. motor 17 in forward running, causing the left rear wheel 4 to move the vacuum cleaner in right turn. When the left operating lever 1 is set at the forward position 5, the relay channel M2 is positively energized for starting the d.c. motor 16 in forward running, causing the right rear wheel 3 to move the vacuum cleaner in left turn.

For making straight movement, set the operating levers 1 and 2 at the forward position 5 at the same time, the signals transmitted therefrom will cause the relay channels M1 and M2 of the receiving circuit (see FIG. 8 and 9) to be positively energized for starting the d.c. motors 16 and 17 both in forward running, causing the rear wheels 3 and 4 to turn in the same direction and move the vacuum cleaner straight forward. When the operating levers are set 1 and 2 at the backward position 6, the relay channel M3 in the receiving circuit will be positively energized, while the relay channels M1 and M2 will be grounded so that the d.c. motors 16 and 17 will be reversely actuated in backward running. As a result, the rear wheels 2 and 4 will also change their direction and move the vacuum cleaner straight backward.

When the operating lever 1 or 2 or both are set at the stop position 7, no signal will be transmitted from the remote control device; therefore, the d.c. motor(s) will stop running or remain idle until the operating lever 1 or 2 or both are placed at other positions 5 or 6 thereat.

Referring to FIG. 2, since the suction pipe 9 with the brush is kept in slight contact with the floor surface, whenever the vacuum cleaner is energized and moving, cleaning operation is automatically performed thereupon. In addition, various types of brushes can be adapted as the floor condition dictates.

Referring to FIGS. 2 and 3, when the power switch 25 is on, but the voltmeter 26 indicates low power level thereat, turn off all the power switches 23 and 25, open the side cover 27, take out the charging plug 19 and connect it to the commercial power source for recharging the storage battery 21 through the rectifying and charging means 18 until the storage battery 21 is fully charged thereat. The rectifying and charging means can be adapted to any commercial source with 110 V or 220 V in 50 Hz or 60 Hz.

For removing the dust from the vacuum cleaner after the operation is done, just open the upper cover 12 (see FIG. 2) and take out the filter 11 (see FIG. 3) by turning loose the butterfly nuts 13. In addition, the filter bowl 14 and the filter cloth 10 can also be taken out for further cleaning action. After the dust removed, replace the cleaned filter 11 and/or the filter bowl 14 and the filter cloth 10, turn to tighten the butterfly nuts 13, and replace the upper cover 12, making it ready for next operation.

Furthermore, the storage battery 21 can be adapted to a 12 V-battery set with 500 watt-hour capacity. Based on the power consumption of 70 watts for the vacuum cleaner and 25 watts each for the d.c. motors 16 and 17, the full capacity of the storage battery set 21 can sustain as long as three hours under continuous operation, suitable for general usage.

Concerning the movement condition, the revolution speed of the d.c. motors 16 and 17 is 1700 RPM, while the speed reduction ratio of the speed reducers 31 and 32 is 1:17 with respect to the revolution of the motors 16 and 17. In this connection, if a speed of 100 RPM is applied to the two rear wheels 3 and 4 made of 10 cm diameters, the movement of the wheels 3 and 4 is 30 meters per minute on the floor, adequate for cleaning any interior area in general buildings.

Furthermore, this radio vacuum cleaner can also be adapted to a portable vacuum cleaner for cleaning furniture, wall, table or other surfaces, simply by taking off the suction pipe 9 and connecting a supplemental suction hose (not shown) between the protruding tube 15 (see FIG. 3) and the suction pipe 9, convenient for any desired dust cleaning work.

While a preferred embodiment has been illustrated and described, it will be apparent that many changes may be made in the general construction and arrangement of the invention without departing from the spirit thereof, and it is therefore desired that the invention be not limited to the exact disclosure but only to the extent of the appending claims.

I claim:

1. A remote-control radio vacuum cleaning system comprising:

(a) remote radio signal transmitting means capable of generating a carrier matched with multivibrator generated frequencies as control signals, and having plural push-button control means for controlling transmission and generation of said carrier matched frequencies; and (b) vacuum cleaning means comprising, a vacuum cleaning device having drive means comprising a pair of d.c. motor sets for propulsing said vacuum cleaning device, rechargeable d.c. power supply means for supplying power to said pair of d.c. motor sets, electronic control means comprising four sets of relay channels, one of said four sets of relay channels controlling on and off operation of said vacuum cleaning device, and the others of the said four sets of relay channels associated with said drive means for controlling propulsive movement of said vacuum cleaning device, and radio signal receiving means associated with said four sets of relay channels for receiving and demodulating control signals of the multivibrator frequencies from said remote radio signal transmitting means for controlling the closing and opening of respective ones of said four sets of relay channels, whereby cleaning operation can be performed under control of said remote radio signal transmitting means.

2. A remote-control radio vacuum cleaning system as in claim 1 wherein said d.c. power source is a set of storage batteries which can be charged as their condition dictates.

3. A remote-control radio vacuum cleaning system as in claim 1 wherein said drive means system includes at least two d.c. motors, and speed reducers matched with said d.c. motors for making controlled movement with respect to said radio receiving circuit thereof.

4. A remote-control radio vacuum cleaning system as in claim 3 wherein said vacuum cleaning means has wheels coupled with said d.c. motors for making forward and backward straight movements, as well as left and right turns therewith in response to predetermined carrier matched frequency signals received.

5. A remote control radio vacuum cleaning system according to claim 1 wherein said remote radio signal transmitting means further comprises a power switch for turning said rechargeable d.c. power supply means on and off, a remote control switch for starting said vacuum cleaning device, and an operating button having forward, reverse, and stop positions for providing desired control signals to said radio signal receiving means.

6. A remote-control radio vacuum cleaning system as in claim 5 wherein said d.c. power supply means comprises a charging means associated with said storage batteries.

7. A remote control radio vacuum cleaning system according to claim 1 wherein said remote radio signal transmitting means comprises self-excited multivibrator means associated with a crystal oscillator and a short-wave amplitude modulator, and an antenna for operating said control signals, and said radio signal receiving means comprising a super-regenerative detector for detecting and receiving the signals, and amplifying means for amplifying the detected and received signals.

8. A remote control radio vacuum cleaning system according to claim 7 wherein said super-regenerative detector is adapted for detecting signals from said remote radio signal transmitting means at a distance of up to about 50 meters.

* * * * *